US010053826B1

(12) United States Patent
Null et al.

(10) Patent No.: US 10,053,826 B1
(45) Date of Patent: Aug. 21, 2018

(54) WING PLOW APPARATUS

(71) Applicant: Alamo Group Inc., Seguin, TX (US)

(72) Inventors: Spencer J. Null, Kansas City, KS (US); Matthew H. Hood, Fairway, KS (US); Randal M. Wolf, Tonganoxie, KS (US)

(73) Assignee: Alamo Group Inc., Seguin, TX (US)

( * ) Notice: Subject to any disclaimer, the term of this patent is extended or adjusted under 35 U.S.C. 154(b) by 269 days.

(21) Appl. No.: 14/967,040

(22) Filed: Dec. 11, 2015

Related U.S. Application Data

(60) Provisional application No. 62/091,254, filed on Dec. 12, 2014.

(51) Int. Cl.
*E01H 5/06* (2006.01)

(52) U.S. Cl.
CPC ..... *E01H 5/067* (2013.01); *E01H 5/061* (2013.01)

(58) Field of Classification Search
CPC ..... E01H 5/067; E01H 5/061
USPC ..... 37/231
See application file for complete search history.

(56) References Cited

U.S. PATENT DOCUMENTS

| | | | | |
|---|---|---|---|---|
| 1,645,837 A | | 10/1927 | Wadsworth | |
| 1,853,939 A | | 4/1932 | Soule et al. | |
| 1,956,007 A | | 4/1934 | Davin et al. | |
| 2,011,777 A | * | 8/1935 | Ritchic ..... | E02F 3/7686 172/305 |
| 2,193,532 A | | 3/1940 | Frink | |
| 2,565,337 A | | 8/1951 | Allan | |
| 2,584,217 A | | 2/1952 | Morkoski | |
| 2,682,822 A | * | 7/1954 | Toland ..... | A01B 63/16 172/386 |
| 2,874,656 A | | 3/1957 | Sheppard | |
| 2,886,114 A | | 5/1959 | Peterson | |
| 2,961,054 A | | 11/1960 | Green | |
| 2,987,127 A | | 6/1961 | Morrison | |
| 2,991,566 A | | 7/1961 | Sumner et al. | |
| 3,125,818 A | | 3/1964 | Kraft et al. | |

(Continued)

FOREIGN PATENT DOCUMENTS

| | | |
|---|---|---|
| CA | 2 748 223 A1 | 2/2012 |
| EP | 0 467 310 B1 | 6/1994 |

(Continued)

OTHER PUBLICATIONS http://www.universaltruckequipment.com/wp-content/uploads/Literature-BW-Tilt-Front-Back-3.16.pdf, (2 pages) Mar. 2015.

(Continued)

*Primary Examiner* — Jamie L McGowan
(74) *Attorney, Agent, or Firm* — Pizarro Allen PC

(57) ABSTRACT

A wing plow assembly may include a base configured for attachment to a vehicle; an upper arm rotatable about a first axis; a lower arm rotatable about a second axis; a lifting member rotatable about a third axis; a support pivotally attached to the upper arm and the lower arm; and an actuator pivotally attached to the base and the lifting member; wherein the actuator is configured for raising and lowering the support by engagement of the lifting member with the upper arm; wherein the lifting member is rotationally decoupled from the upper arm such that the upper arm is disengageable from the lifting member. At least one of the first axis and the second axis may be configured to be substantially parallel to a longitudinal axis of the vehicle.

16 Claims, 7 Drawing Sheets

(56) References Cited

U.S. PATENT DOCUMENTS

| | | | | |
|---|---|---|---|---|
| 3,204,352 | A | 9/1965 | Hughes | |
| 3,429,380 | A | 2/1969 | Launder et al. | |
| 3,483,643 | A | 12/1969 | Wenzel | |
| 3,587,182 | A | 6/1971 | Hirt | |
| 3,587,751 | A | 6/1971 | Schmidt, Jr. | |
| 3,588,147 | A | 6/1971 | Enters | |
| 3,659,363 | A | 5/1972 | Snyder | |
| 3,664,057 | A | 5/1972 | Dunn | |
| 3,715,872 | A | 2/1973 | Thompson, Jr. | |
| 3,720,010 | A | 3/1973 | Coates | |
| 4,029,338 | A | 6/1977 | Headley | |
| 4,045,892 | A | 9/1977 | Farrell | |
| 4,096,652 | A | 6/1978 | Raines et al. | |
| 4,183,195 | A | 1/1980 | James | |
| 4,320,589 | A | 3/1982 | Pelazza | |
| 4,357,766 | A | 11/1982 | Croteau et al. | |
| 4,479,312 | A | 10/1984 | Turgeon | |
| 4,495,754 | A | 1/1985 | Gartner | |
| 4,565,018 | A | 1/1986 | Oya | |
| 4,570,367 | A | 2/1986 | Oya | |
| 4,596,081 | A | 6/1986 | DeBilly et al. | |
| 4,744,159 | A | 5/1988 | Houle | |
| 4,798,011 | A | 1/1989 | Sprinkle | |
| 4,969,280 | A | 11/1990 | Thornloe | |
| 5,031,343 | A | 7/1991 | Houle et al. | |
| 5,148,617 | A | 9/1992 | Feller et al. | |
| 5,177,887 | A | 1/1993 | McGuggan et al. | |
| 5,427,185 | A | 6/1995 | Seal | |
| 5,488,788 | A | 2/1996 | Durbin | |
| 5,809,672 | A | 9/1998 | Jones | |
| 5,819,444 | A | 10/1998 | Desmarais | |
| 6,098,719 | A | 8/2000 | Turner | |
| 6,249,992 | B1 | 6/2001 | Irving et al. | |
| 6,408,547 | B1 | 6/2002 | Jones et al. | |
| 6,412,200 | B1 | 7/2002 | Savard | |
| 6,442,877 | B1 | 9/2002 | Quenzi et al. | |
| 6,526,677 | B1 | 3/2003 | Bloxdorf et al. | |
| 6,581,306 | B1 * | 6/2003 | DiClementi | E01H 5/06 248/565 |
| 6,581,307 | B1 | 6/2003 | Jones et al. | |
| 6,871,425 | B2 | 3/2005 | Feller | |
| 6,922,924 | B2 | 8/2005 | Jones et al. | |
| 6,941,686 | B2 | 9/2005 | Cusick | |
| 7,033,105 | B2 | 4/2006 | Catenacci et al. | |
| 7,107,710 | B2 | 9/2006 | Savard | |
| 7,523,569 | B2 | 4/2009 | Savard | |
| 7,624,520 | B2 | 12/2009 | Gordon | |
| 7,918,042 | B2 | 4/2011 | Ropog | |
| 7,954,262 | B2 | 6/2011 | Bernier | |
| 8,596,376 | B2 | 12/2013 | Holverson et al. | |
| 8,732,988 | B2 | 5/2014 | Hanson | |
| 9,085,860 | B2 | 7/2015 | Dubiel | |
| 9,151,007 | B2 * | 10/2015 | Osgood | E01H 5/06 |
| 9,695,561 | B2 * | 7/2017 | Godwin, Jr. | E01H 5/061 |
| 9,752,293 | B2 * | 9/2017 | Dubiel | E01H 5/067 |
| 2003/0066210 | A1 | 4/2003 | Hollinrake et al. | |
| 2003/0101626 | A1 * | 6/2003 | Johnson | E01H 5/06 37/231 |
| 2005/0204587 | A1 | 9/2005 | Kime | |
| 2007/0271828 | A1 | 11/2007 | Mishra et al. | |
| 2012/0024551 | A1 | 2/2012 | Holverson et al. | |
| 2012/0285050 | A1 | 11/2012 | Osgood | |
| 2012/0311893 | A1 | 12/2012 | Knott et al. | |
| 2013/0160333 | A1 | 6/2013 | Becicka et al. | |
| 2013/0227863 | A1 | 9/2013 | Stephan | |
| 2014/0054052 | A1 | 2/2014 | Holverson | |
| 2014/0196322 | A1 | 7/2014 | Dubiel | |
| 2014/0250738 | A1 | 9/2014 | Osgood | |
| 2014/0326472 | A1 | 11/2014 | Holverson et al. | |

FOREIGN PATENT DOCUMENTS

| | | | |
|---|---|---|---|
| FI | 75625 | B | 3/1988 |
| GB | 2 172 037 | A | 9/1986 |
| SE | 466317 | B | 1/1992 |

OTHER PUBLICATIONS

Photograph dated of Jul. 24, 2014 of Universal Truck Equipment Uni-Tilt wing plow product, (1 page) Jul. 24, 2014.

* cited by examiner

WING PLOW APPARATUS

CROSS REFERENCE TO RELATED APPLICATIONS

This application claims priority to U.S. Provisional Patent Application No. 62/091,254 filed Dec. 12, 2014, the disclosure of which is incorporated herein by reference.

BACKGROUND

In the field of snow plows in general, and wing plows in particular, it is a challenge to provide equipment that may thoroughly, consistently, and safely clear a roadway of snow. In particular, it is a challenge to provide good snow removal while avoiding a tendency of a snow plow to dig into or gouge a roadway due to uneven road surfaces. It would be a significant advancement in the art to provide a snow plow that may thoroughly, consistently, and safely clear a roadway of snow yet avoid digging into the roadway and potential damage associated with the same.

SUMMARY

A wing plow assembly may include a base configured for attachment to a vehicle; an upper arm attached to the base, the upper arm being rotatable about a first axis; a lower arm attached to the base, the lower arm being rotatable about a second axis; a lifting member attached to the base, the lifting member being rotatable about a third axis; a support pivotally attached to the upper arm and the lower arm, the support including an attachment configured for attaching a plow to the assembly; and an actuator pivotally attached to the base and the lifting member. The actuator may be configured for raising and lowering the support (and hence the plow) by engagement of the lifting member with the upper arm. The lifting member may be rotationally decoupled from the upper arm such that the upper arm may be lifted off of, or disengaged from, the lifting member if the plow encounters a raised portion in the roadway, for example. As a result, a wing plow assembly as described herein may allow the wing plow to ascend and descend smoothly over uneven road surfaces and thereby avoid the forward portion "digging in" or bouncing off the road surface.

BRIEF DESCRIPTION OF THE DRAWINGS

Examples of wing plow assemblies as described herein are shown in the accompanying drawings in which.

DETAILED DESCRIPTION

The following terms as used herein should be understood to have the indicated meanings unless the context requires otherwise.

When an item is introduced by "a" or "an," it should be understood to mean one or more of that item.

"Comprises" means includes but is not limited to.

"Comprising" means including but not limited to.

"Having" means including but not limited to.

As described in detail below, the present application is directed to a wing plow assembly that provides enhanced functionality and safety by eliminating or reducing a tendency of the wing plow to dig into or bounce off a road surface during snow plowing operations, for example. A wing plow assembly as described herein may allow the wing plow to ascend and descend smoothly over uneven road surfaces. In this manner, a wing plow assembly may avoid the forward portion "digging in" or bouncing off the road surface, which could cause damage to the wing plow or the vehicle to which the wing plow is mounted as well as unsatisfactory or inconsistent plowing results.

Figure 1:
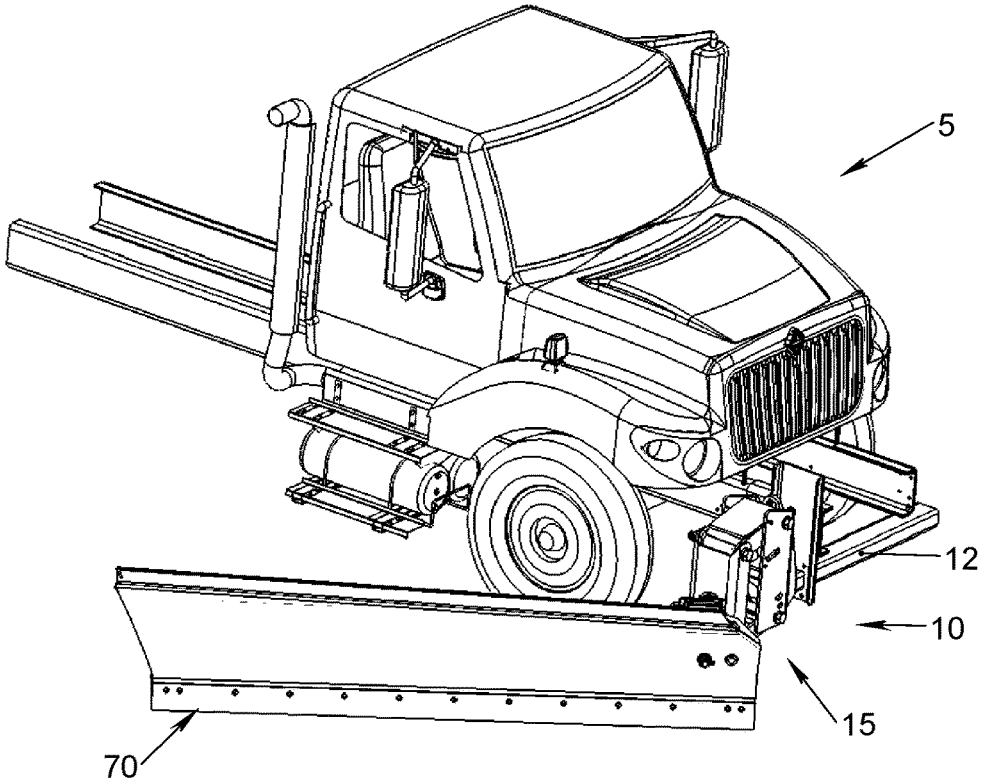
FIG. 1 is a front perspective view of a wing plow assembly mounted to a vehicle.
Figure 2:
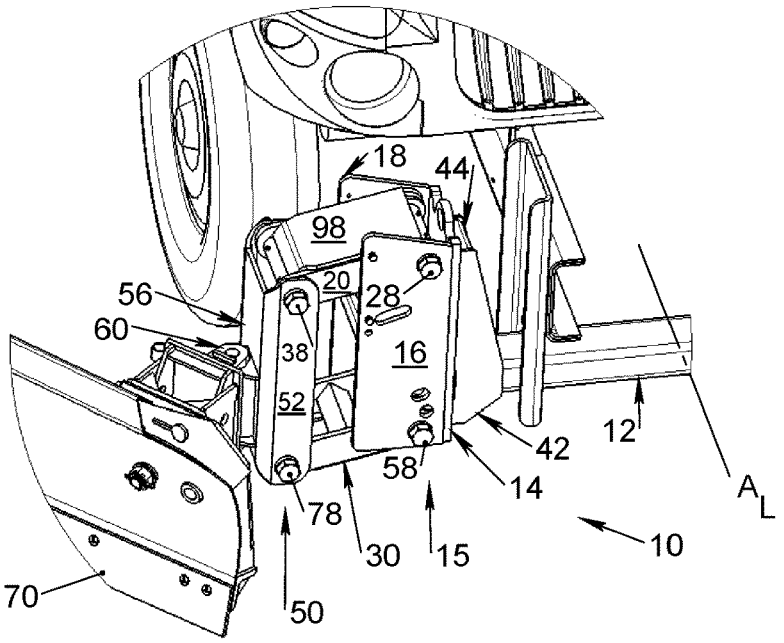
FIG. 2 is a front perspective view of a portion of the wing plow assembly of FIG. 1 shown in a partially lowered position.
Figure 3:
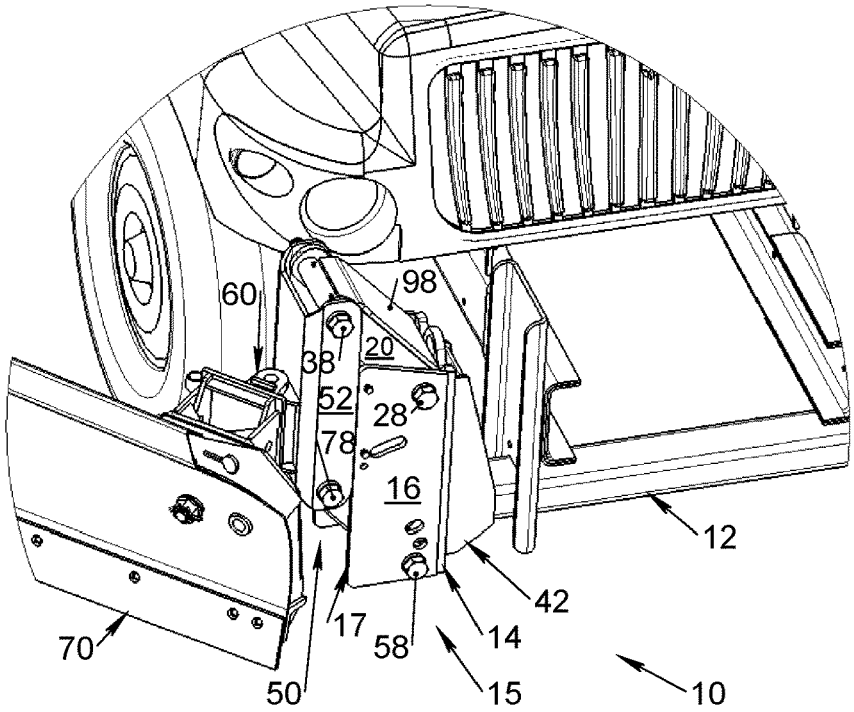
FIG. 3 is a front perspective view of a portion of the wing plow assembly of FIG. 1 shown in a fully raised position.

As shown in FIGS. 1-11, a wing plow assembly 10 having a wing plow 70 may be mounted to a vehicle 5 with a beam 12 or other suitable attachment. Wing plow assembly 10 may include a base structure 15 having a plurality of rigidly attached plates 14, 16, 18 depending from beam 12, for example, or other suitable mounting structure. For example, gussets 42, 44 may be attached to plate 14 and beam 12 for increased strength and stability. An upper arm 20 and a lower arm 30 may be pinned to base structure 15 via pins 28 and 58, respectively. Upper arm 20 and lower arm 30 may also be pinned to a support 50 via pins 38 and 78, respectively. Support 50 may include a plurality of rigidly attached plates 52, 54, 56 or other suitable structure. Upper arm 20 and lower arm 30 may rotate about pins 28 and 58, respectively, between a lowered position as shown in FIG. 2, for example, and a raised position as shown in FIG. 3, for example, thereby lowering and raising plow 70 with respect to a road surface, as described further below. An actuator 80, such as a hydraulic or pneumatic actuator having a cylinder 82 and piston 84, for example (see FIGS. 7-8), may be provided to raise and lower plow 70 as described further below. In some embodiments, upper arm 20 and lower arm 30 may extend substantially laterally (e.g., substantially perpendicular to a longitudinal axis $A_L$ of vehicle 5) and may be substantially the same length such that they remain substantially parallel as they rotate about pins 28 and 58, respectively. In some embodiments, pins 28 and 58 and pins 38 and 78 may be oriented substantially parallel to each other and substantially parallel to a longitudinal axis $A_L$ of vehicle 5 (e.g., aligned with a forward direction of travel), pins 28 and 58 may be substantially vertically aligned with each other, and pins 38 and 78 may be substantially vertically aligned with each other. Of course, any suitable orientation of pins 28, 38, 58, and 78 may be used, if desired.

Figure 4:
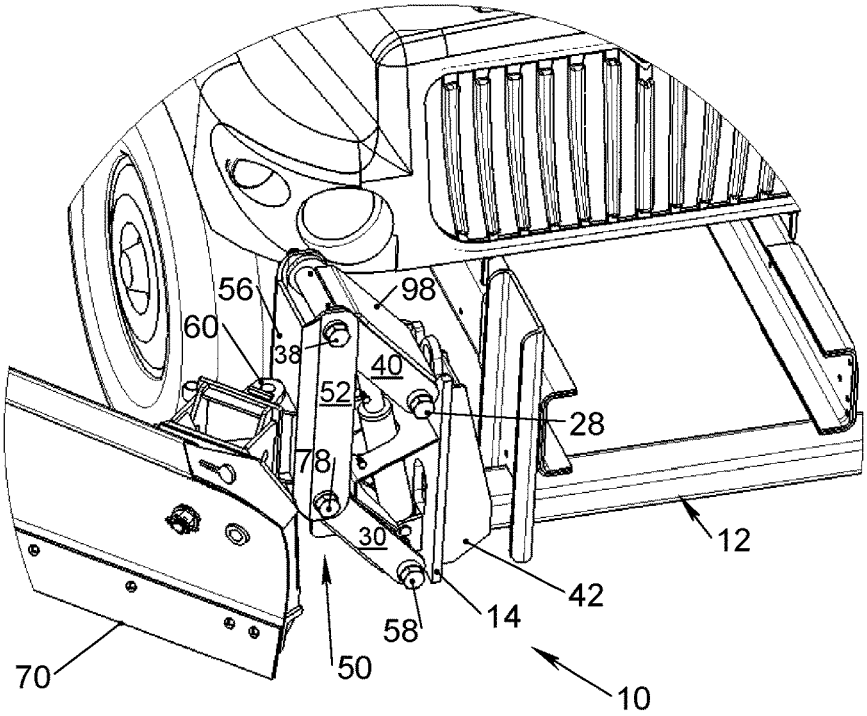
FIG. 4 is a front perspective view of a portion of the wing plow assembly of FIG. 1 shown in a fully raised position, with a lifting member engaged with an upper arm.
Figure 5:
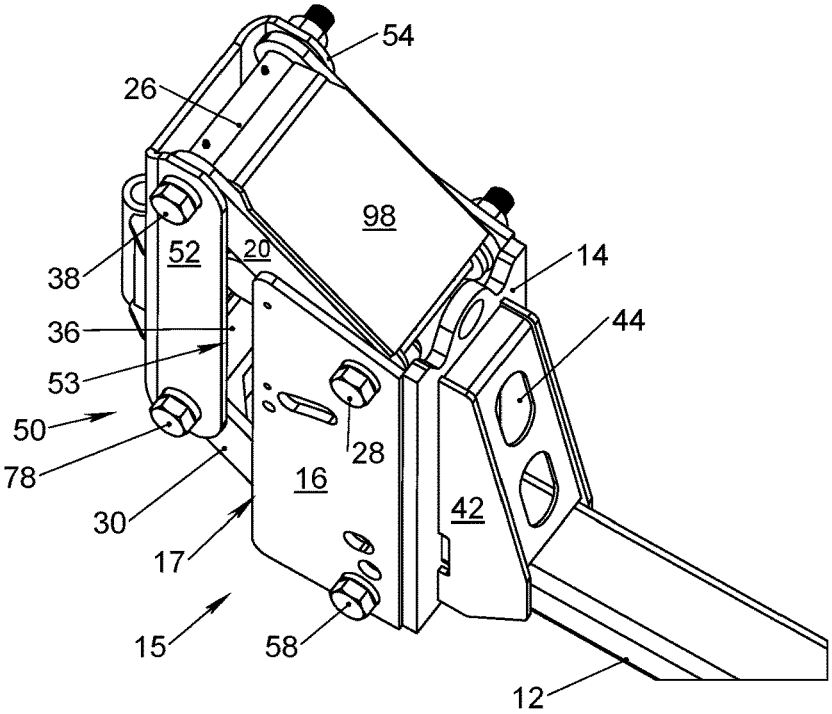
FIG. 5 is a front perspective view of a portion of the wing plow assembly of FIG. 1 shown in a partially raised position.
Figure 6:
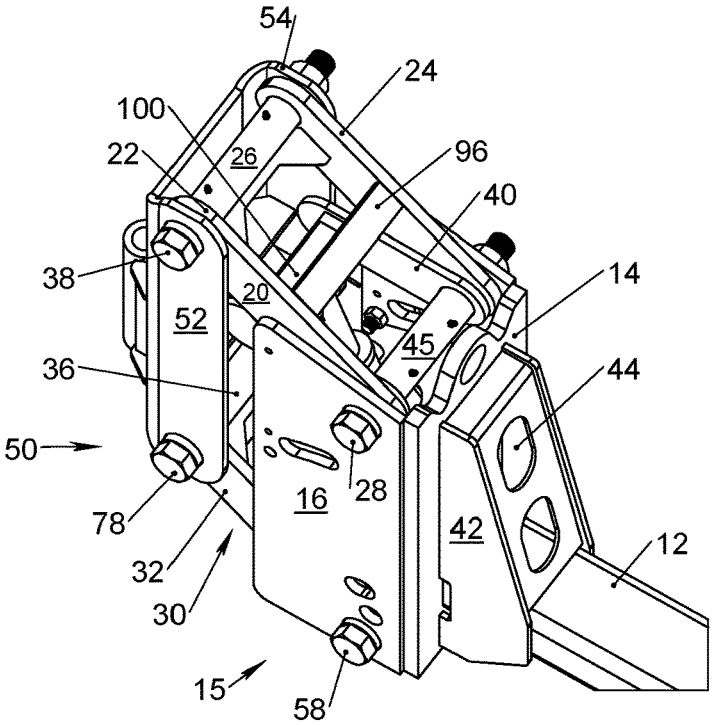
FIG. 6 is a front perspective view of a portion of the wing plow assembly of FIG. 1 shown in a partially raised position, with the lifting member not engaged with the upper arm.
Figure 7:
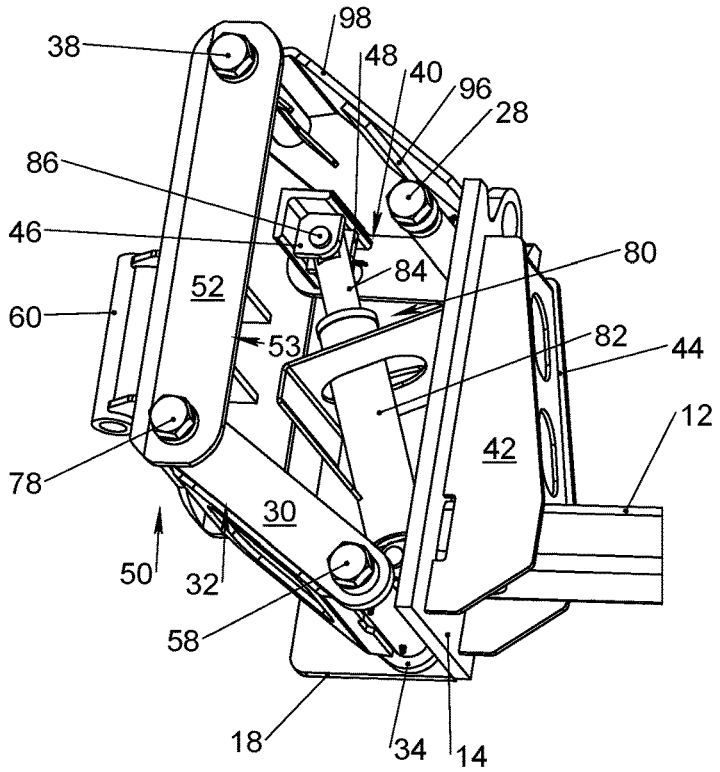
FIG. 7 is another front perspective view of a portion of the wing plow assembly of FIG. 1 shown in a raised position, with the lifting member not engaged with the upper arm.
Figure 8:
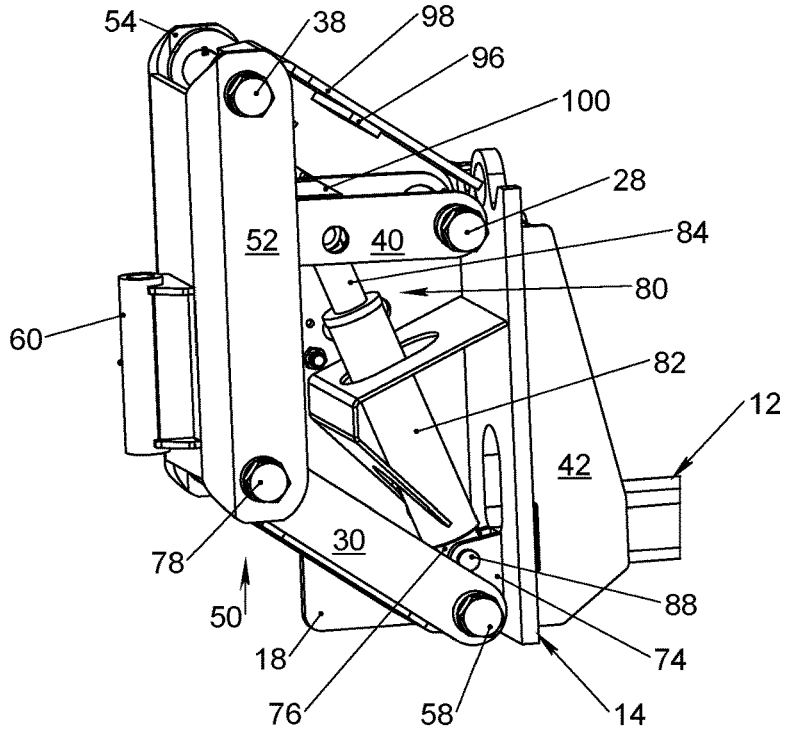
FIG. 8 is yet another front perspective view of a portion of the wing plow assembly of FIG. 1 shown in a raised position, with the lifting member not engaged with the upper arm.

As shown in FIGS. 4-8, upper arm 20 may include a pair of spaced apart links 22 and 24, which may be joined at or near their outboard ends by a cylinder 26 through which pin 38 may be disposed (see, e.g., FIGS. 5-6). Similarly, lower arm 30 may include a pair of spaced apart links 32 and 34, which may be joined at or near their outboard ends by a cylinder 36 through which pin 78 may be disposed (see, e.g., FIGS. 6, 7, and 11). A lifting member 40 may be provided between links 22 and 24 of upper arm 20 (see, e.g., FIGS. 4, 6, and 8). Lifting member 40 may include a cylinder 45 through which pin 28 may be disposed. Lifting member 40 may have a bearing plate 100 configured to engage with a bearing plate 96 of upper arm 20. In some embodiments, a lifting plate 98 may be attached to upper arm 20, such as by attachment to links 22 and 24, for example. In some embodiments, bearing plate 96 may be attached to, or integral with, an underside of lifting plate 98. In addition to providing enhanced strength and stability, lifting plate 98 may serve as a protective cover over actuator 80. In some embodiments, lifting member 40 and upper arm 20 may rotate about the same axis (e.g., pin 28), and in other embodiments lifting member 40 and upper arm 20 may rotate about different axes. In FIGS. 4 and 8, plate 16 and link 22 of upper arm 20 are not shown for clarity. Similarly, in FIG. 6, lifting plate 98 is not shown for clarity, and in FIG. 7, the forward arm of lifting member 40 as well as plate 16 and link 22 of upper arm 20 are not shown for clarity.

As illustrated in FIG. 7, an underside of lifting member 40 may have a pair of bosses 46 and 48 configured for mounting one end of actuator 80 via a pin 86, for example. The other end of actuator 80 may be mounted to bosses 74 and 76 depending from plate 14 via a pin 88, for example (see FIG. 8). As actuator 80 is extended from a retracted position, bearing plate 100 of lifting member 40 may be engaged with bearing plate 96 of upper arm 20, thereby lifting support 50 and plow 70 upward. Similarly, as actuator 80 is retracted from an extended position, with bearing plate 96 resting on bearing plate 100, lifting member 40 may allow support 50 and plow 70 to be lowered. Alternatively, in some embodiments, lifting member 40 may have one or more protrusions that engage with lower edges of links 22 and 24 in order to raise and lower support 50 and plow 70. To accommodate uneven road surfaces, lifting member 40 may be rotationally decoupled from upper arm 20 such that upper arm 20 may lift off of lifting member 40 (that is, with bearing plate 96 not engaged with bearing plate 100) if plow 70 encounters a raised portion in the roadway, for example, as shown in FIGS. 6-8. As plow 70 passes over such raised portion of the roadway, upper arm 20 may then return to engagement with lifting member 40. Such a configuration may eliminate or reduce a tendency of plow 70 to dig into the roadway.

In some embodiments, the range of motion of upper arm 20 and lower arm 30 (and hence support 50 and plow 70) may be limited by stops, detents, or other suitable safeguards. For example, in some embodiments, edge 17 of plate 16 may engage with edge 53 of plate 52 (and/or edge 19 of plate 18 may engage with edge 55 of plate 54) to define lower and upper limits of such range of motion (see FIGS. 3, 5, 9, and 11, for example). Of course, other suitable limiting arrangements may be provided, depending on the desired range of motion.

Figure 9:
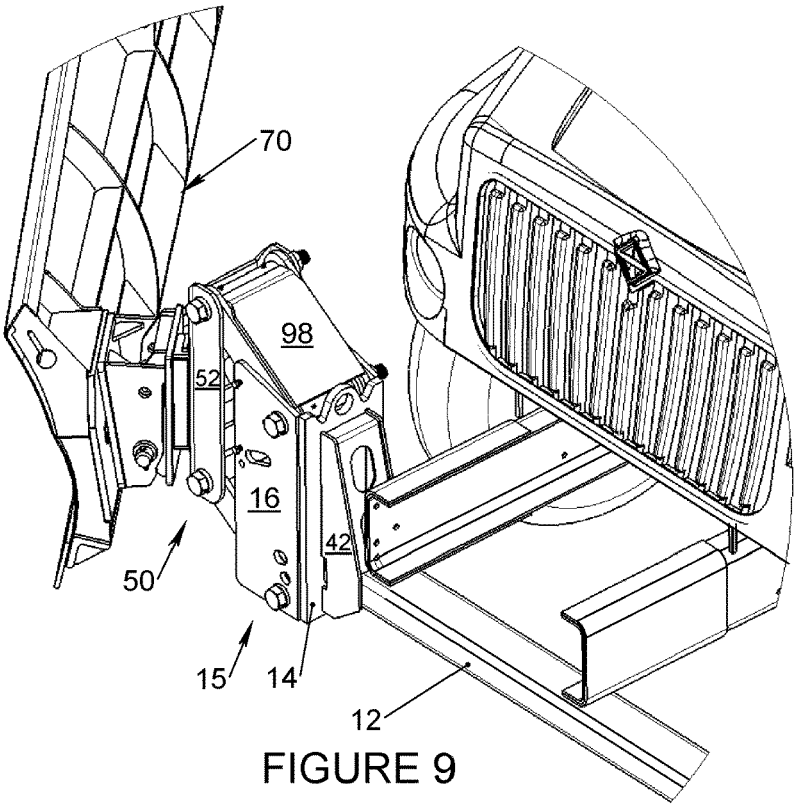
FIG. 9 is still another front perspective view of a portion of the wing plow assembly of FIG. 1 shown in a raised position.
Figure 10:
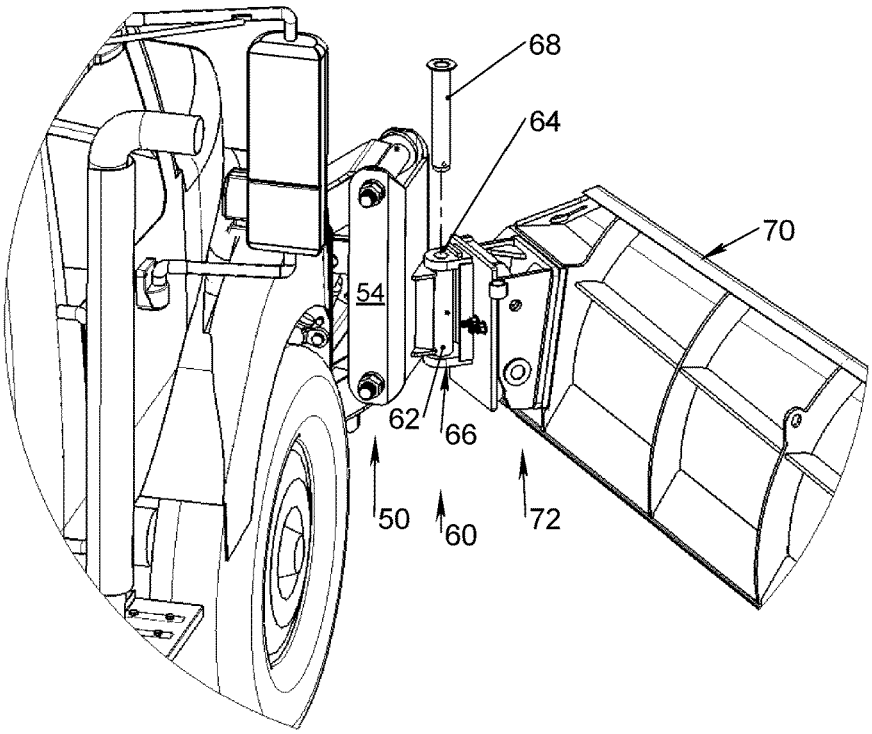
FIG. 10 is a rear perspective view of a portion of the wing plow assembly of FIG. 1 shown in a raised position.
Figure 11:
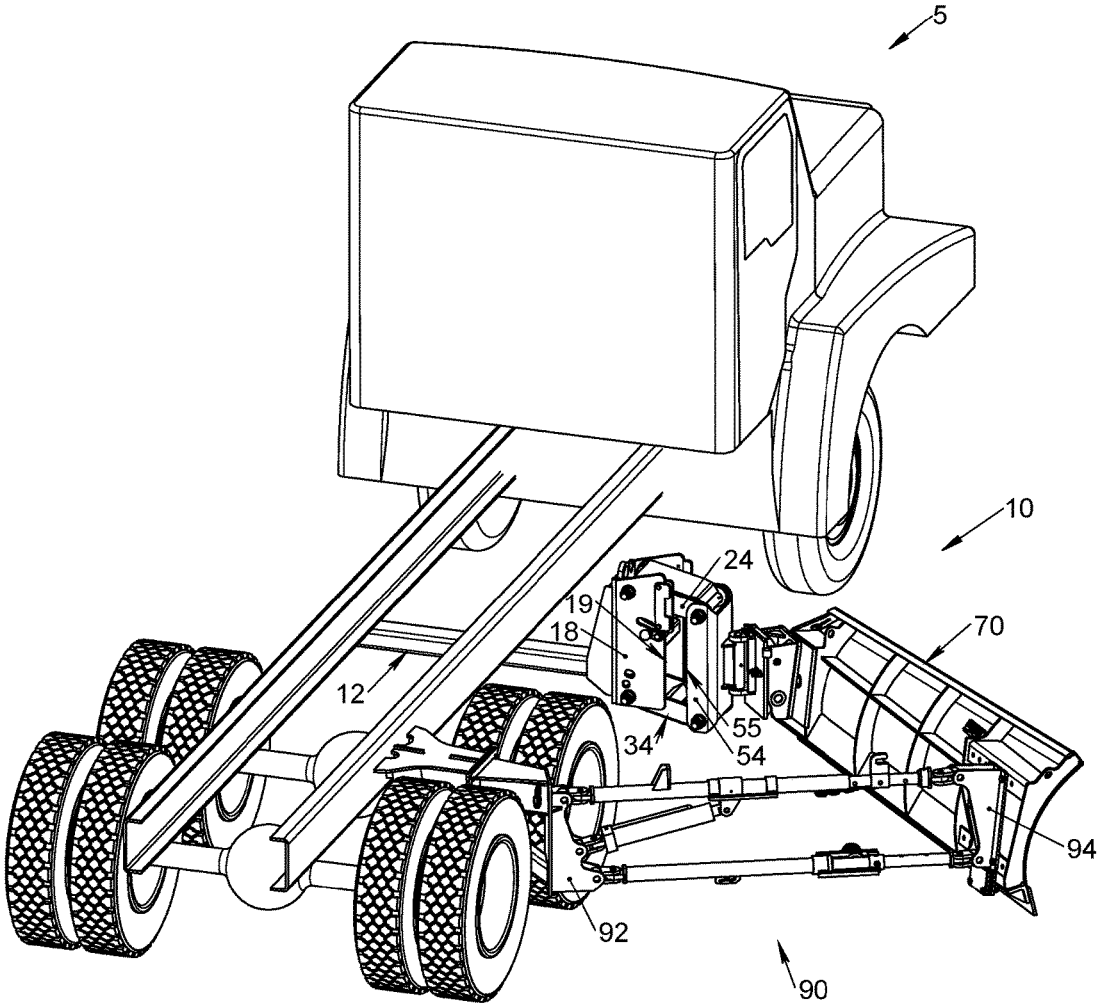
FIG. 11 is another rear perspective view of the wing plow assembly of FIG. 1 shown in a partially lowered position.

As shown in FIGS. 9-11, plow 70 may be pivotally mounted to support 50 via a hinge 60, for example, or other suitable attachment, either directly or via a mount 72. For example, hinge 60 may include a cylinder 62 depending from support 50, a pair of bosses 64 and 66 depending from plow 70 or mount 72, and a pin 68 extending through cylinder 62 and bosses 64 and 66. Of course, any suitable hinge, pin, or other rotational connection may be used to allow plow 70 to rotate about support 50 in a range of motion alongside vehicle 5. In some embodiments, an actuator 90 may be provided between a mount 92 attached to vehicle 5 and a mount 94 attached to plow 70. Actuator 90 may be pivotally connected to mount 92 and mount 94. Actuator 90 may be extended and retracted as desired in order to place plow 70 in a desired angular position with respect to vehicle 5.

Figure 12:
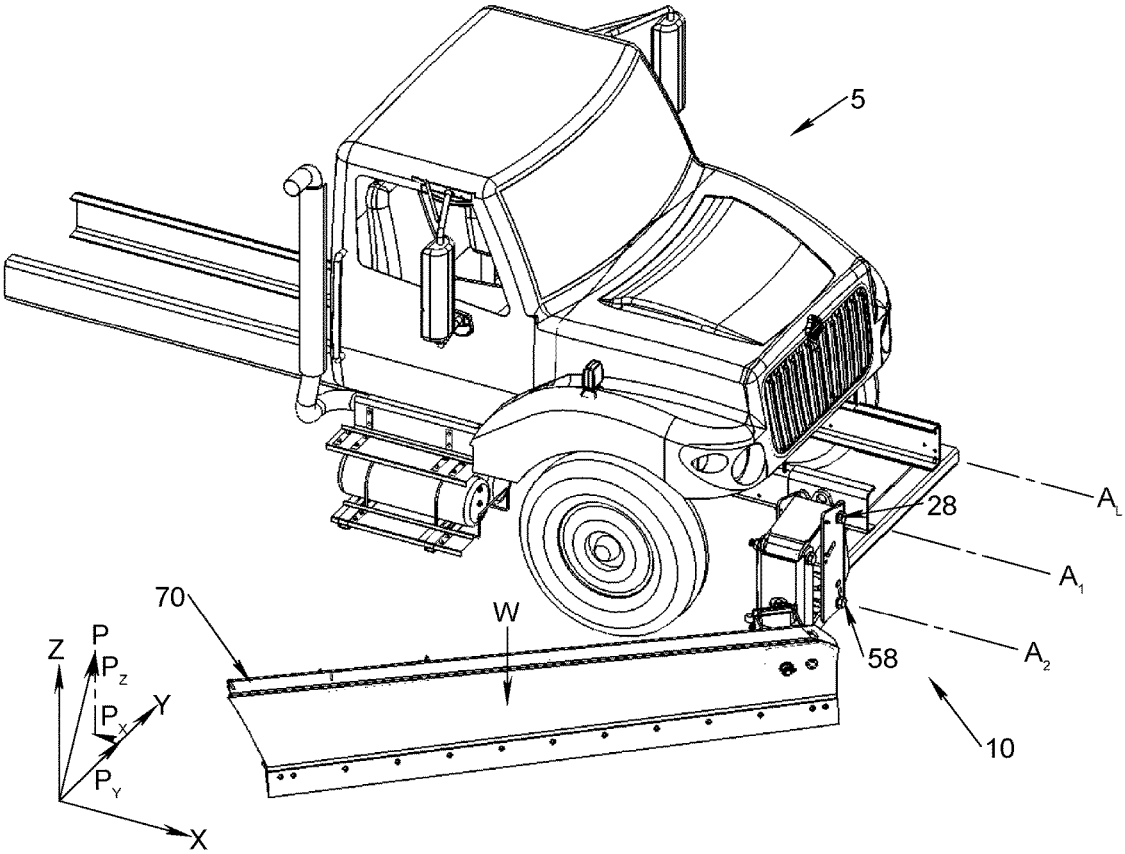
FIG. 12 is a front perspective view of the wing plow assembly and vehicle of FIG. 1 illustrating forces acting on the plow.

Referring to FIG. 12, persons of ordinary skill in the art will appreciate that wing plow assembly 10 may be mounted to vehicle 5 as described above and used to clear snow or other materials from a roadway as vehicle 5 is driven in a forward direction as indicated by longitudinal axis $A_L$. During such plowing operations, plow 70 may ascend and descend smoothly over uneven road surfaces due to the decoupling of lifting member 40 from upper arm 20 as described above. The forces acting on plow 70 may include a weight W and a resultant force P, which may be resolved into components $P_x$ , $P_y$, and $P_z$, in a Cartesian coordinate system (x, y, z) in which the x-axis is aligned with longitudinal axis $A_L$, the y-axis is pointing laterally out the left side of vehicle 5, and the z-axis is vertical. In the embodiment illustrated in FIG. 12, pin 28 is shown having a central axis $A_1$, pin 58 is shown having a central axis $A_2$, and axes $A_1$ and $A_2$ (about which arms 20 and 30 respectively rotate as described above) may be substantially parallel to longitudinal axis $A_L$. Such a configuration may be particularly useful in reducing or eliminating unwanted "chatter" or bouncing of plow 70 during operation. Specifically, due to the inward action of the lateral force component $P_y$ at an elevation below axes $A_l$ and $A_2$, the lateral force component $P_y$ may provide a positive moment about axes $A_1$ and $A_2$ that (along with weight W) tends to hold plow 70 down. Plow 70 may be allowed to rise, e.g., over a bump in the roadway, in accordance with the aforementioned decoupling, if the vertical force component $P_z$, is of a sufficient magnitude to produce a negative moment about axes $A_1$ and $A_2$ that is sufficient to overcome the moment produced by lateral force component $P_y$ and weight W. Thus, wing plow assembly 10 may not only readily accommodate uneven road surfaces but also keep plow 70 biased toward a down position in order to reduce or eliminate unwanted "chatter" or bouncing of plow 70 during plowing operations.

The embodiments described herein are some examples of the current invention. Various modifications and changes of the current invention will be apparent to persons of ordinary skill in the art. Among other things, any feature described for one embodiment may be used in any other embodiment. Terms such as "first" and "second" are used to distinguish certain items and should not be construed to require a certain order or level of importance unless specifically so stated. Similarly, terms such as "upper" and "lower" are used to distinguish certain items and should not be construed to require a certain orientation unless specifically so stated. The scope of the invention is defined by the attached claims and other claims to be drawn to this invention, considering the doctrine of equivalents, and is not limited to the specific examples described herein.

What is claimed is:

1. A wing plow assembly comprising:

a base configured for attachment to a vehicle;

an upper arm attached to said base, said upper arm being rotatable about a first axis;

a lower arm attached to said base, said lower arm being rotatable about a second axis;

a lifting member attached to said base, said lifting member being rotatable about a third axis;

a support pivotally attached to said upper arm and said lower arm, said support comprising an attachment configured for attaching a plow to said assembly; and an actuator pivotally attached to said base and said lifting member;

wherein said actuator is configured for raising and lowering said support by engagement of said lifting member with said upper arm;

wherein said lifting member is rotationally decoupled from said upper arm such that said upper arm is disengageable from said lifting member in a disengaged position.

2. The wing plow assembly of claim 1 wherein said first axis and said third axis are the same.

3. The wing plow assembly of claim 1 wherein said first axis and said second axis are substantially parallel and vertically aligned.

4. The wing plow assembly of claim 1 wherein at least one of said first axis and said second axis is configured to be substantially parallel to a longitudinal axis of the vehicle when said base is attached to the vehicle.

5. The wing plow assembly of claim 1 wherein said upper arm and said lower arm are respectively pinned to said support about a fourth axis and a fifth axis.

6. The wing plow assembly of claim 5 wherein said first and second axes are substantially parallel and vertically aligned with each other, and wherein said fourth and fifth axes are substantially parallel and vertically aligned with each other.

7. The wing plow assembly of claim 1 wherein said upper arm comprises a pair of spaced apart links.

8. The wing plow assembly of claim 1 wherein said lower arm comprises a pair of spaced apart links.

9. The wing plow assembly of claim 1 wherein said lifting member comprises a first bearing plate configured for engagement with a second bearing plate of said upper arm.

10. The wing plow assembly of claim 9 wherein said upper arm comprises a lifting plate having an underside comprising said second bearing plate.

11. The wing plow assembly of claim 10 wherein said lifting plate is configured to cover said actuator.

12. The wing plow assembly of claim 1 wherein said actuator comprises a hydraulic actuator having a cylinder and a piston, wherein one of said cylinder and said piston is pinned to said base and the other of said cylinder and said piston is pinned to said lifting member.

13. The wing plow assembly of claim 1 wherein, when said base is attached to the vehicle and the plow is mounted to said wing plow assembly, the plow is biased toward a down position during plowing operations due to a lateral resultant force component acting on the plow at an elevation below said first and second axes.

14. The wing plow assembly of claim 1 wherein a range of motion of said upper arm and said lower arm is limited by engagement of an edge of said base with an edge of said support.

15. The wing plow assembly of claim 1 wherein said upper arm and said lower arm are configured to extend substantially perpendicular to a longitudinal axis of the vehicle when said base is attached to the vehicle.

16. A wing plow assembly comprising:

a base configured for attachment to a vehicle having a longitudinal axis;

an upper arm comprising a first pair of spaced apart links pinned to said base at a first upper axis, said upper arm configured for extending substantially perpendicular to the longitudinal axis of the vehicle;

a lower arm comprising a second pair of spaced apart links pinned to said base at a first lower axis, said lower arm configured for extending substantially perpendicular to the longitudinal axis of the vehicle, said first lower axis being substantially parallel to and vertically aligned with said first upper axis;

a support pinned to said upper arm at a second upper axis and pinned to said lower arm at a second lower axis, said support comprising an attachment configured for attaching a plow to said assembly, said second upper axis being substantially parallel to and vertically aligned with said second lower axis;

a lifting member pinned to said base at said first upper axis, said lifting member comprising a third pair of spaced apart links disposed intermediate said first pair of spaced apart links; and an actuator comprising a piston and a cylinder disposed intermediate each of said pairs of spaced apart links, one of said piston and said cylinder being pinned to said base and the other of said piston and said cylinder being pinned to said lifting member;

wherein said actuator is configured for raising and lowering said support by engagement of said lifting member with said upper arm;

wherein said lifting member is rotationally decoupled from said upper arm such that said upper arm is disengageable from said lifting member in a disengaged position;

wherein each of said first upper axis, said first lower axis, said second upper axis, and said second lower axis is configured to be substantially parallel to the longitudinal axis of the vehicle when said base is attached to the vehicle.

* * * * *